United States Patent [19]

Jennie

[11] 4,102,243

[45] Jul. 25, 1978

[54] GAS REGULATOR FOR GAS OPERATED FIREARMS

[75] Inventor: Fred LeRoy Jennie, Anaheim, Calif.

[73] Assignee: Weatherby, Inc., South Gate, Calif.

[21] Appl. No.: 726,939

[22] Filed: Sep. 27, 1976

Related U.S. Application Data

[63] Continuation-in-part of Ser. No. 710,216, Jul. 30, 1976, abandoned.

[51] Int. Cl.[2] ..... F41D 5/08

[52] U.S. Cl. ..... 89/193; 89/191 A

[58] Field of Search ..... 89/191 A, 193

[56] References Cited

U.S. PATENT DOCUMENTS

| | | | |
|---|---|---|---|
| 960,825 | 6/1910 | Colleoni | 89/193 |
| 2,748,662 | 6/1956 | Simpson | 89/193 |
| 3,779,131 | 12/1973 | Kawamura | 89/193 |

*Primary Examiner*—Stephen C. Bentley

*Attorney, Agent, or Firm*—Albert M. Herzig; Edward C. Walsh

[57] ABSTRACT

An improved gas operated firearm utilizing a metering device positioned for regulating the flow of gas from the barrel of the firearm to a piston which operates the action of the firearm. The metering device consists of a metering plug which has an annular rib where the plug is inserted into a cylinder which communicates with the piston which operates the action of the firearm. The area of the gas flow opening between the rib of the metering plug and the bore of the cylinder is thus selectable to one of the flow of gases. The metering plug may also have a plurality of flats on its surface of different dimensions and the metering plug is adjustable to selected positions for varying the degree of restriction posed to gases passing beteween the plug and the bore of the cylinder.

1 Claim, 6 Drawing Figures

GAS REGULATOR FOR GAS OPERATED FIREARMS

This application is a continuation-in-part of application Ser. No. 710,216 filed Jul. 30, 1976, now abandoned.

BACKGROUND OF INVENTION

1. Field of the Invention

The field of the invention relates to gas operated firearms where gases flow from the firearm barrel into an operating piston which actuates an automatic mechanism for extraction, ejection, feeding, and the chambering of ammunition. The particular improvement of the invention is a metering device inserted into a cylinder, thereby controlling the flow of gases into the operating piston.

2. Description of the Prior Art

Attempts have been made in the prior art to control the volume of the gases that flow into operating pistons which actuate automatic mechanisms, for extracting, ejecting, feeding, and chambering ammunition in firearms such as shotguns. These attempts involve the venting of surplus gases to the atmosphere and have met with success when firing shotgun shells having relatively low pressure; however, when heavier loads, such as a magnum shot shell is utilized, severe hardship on firearm mechanisms occurs, and to alleviate this situation, special model firearms are manufactured for the heavy magnum loads or special barrels are used which restrict the flow of gases by means of a smaller gas orifice in the barrel. If the size and area of the orifices in the barrel could be adjusted smaller or larger, the gases entering the actuating piston could be controlled. This method, however, is impractical in the normal course of manufacturing and the herein invention provides a solution to the problem as described in detail hereinafter.

SUMMARY OF THE INVENTION

The invention described herein is embodied in a gas operated firearm, having a gas operated piston for operating the action of the firearm, there being a channel for conveying gas from the barrel of the firearm to a piston which actuates an automatic mechanism for extraction, ejection, feeding and chambering of ammunition. A metering device is utilized within the cylinder with which the piston communicates where the metering device is positioned to restrict the flow of gases between the metering device and the bore of the cylinder. In the preferred embodiment, the metering device consists of a plug which has an annular rib which allows for a pre-determined clearance between the cylinder bore and the rib. The metering plug is reversible within the bore of the cylinder thereby allowing for the selection of the pre-determined clearance within the cylinder bore by which the volume of gases entering into the cylinder may be controlled. In an alternative configuration, the metering plug has flats on its surface, providing a passageway means between the flats and the bore of the cylinder for the passage of gas. These flats are of different dimensions, and the metering plug is adjustable within the cylinder bore to pre-selected positions for varying the degree of restriction posed to gases passing between the plug and the bore of the cylinder. Thus, by restricting the opening within the cylinder bore, the volume of gases entering the actuating piston may be restricted which will allow sufficient volume to actuate the automatic mechanism when firing loads having higher pressures, such as created by magnum shot shells.

The present invention accomplishes the result of metering the gas flow for all varieties of loads from low to high pressure, including magnum shot shells, without having to interchange the firearm barrel.

In the light of the foregoing, the primary object of the invention is to provide an improvement in gas operated firearms to accommodate loads from high pressures to low pressures, without having to interchange the firearm barrel.

A further object is to provide an improvement, as in the foregoing object, wherein a metering device is provided which is inserted into a cylinder communicating with an operating piston which permits selectable control of the volume of gases entering the cylinder, thereby controlling the pressures exerted upon the piston operating the automatic mechanism for extraction, ejection, feeding, and chambering of ammunition.

A further object is to provide an improvement as in the foregoing wherein the metering device is in the form of a metering plug having annular ribs where the metering plug is reversible within the cylinder with which the operating piston communicates, such reversibility permitting selected orifices within the cylinder for control of high pressure shot shell loads.

It is a further object to provide an improvement as in the foregoing, wherein the metering device is a metering plug having flats on its surface of different dimensions, where the metering plug is adjustable to selected positions for varying the degree of restriction posed to gases passing between the plug and the bore of the cylinder.

Further objects and additional advantages of the invention will become apparent from the following detailed description and annexed drawings.

DESCRIPTION OF THE PREFERRED EMBODIMENT

Figure 1:
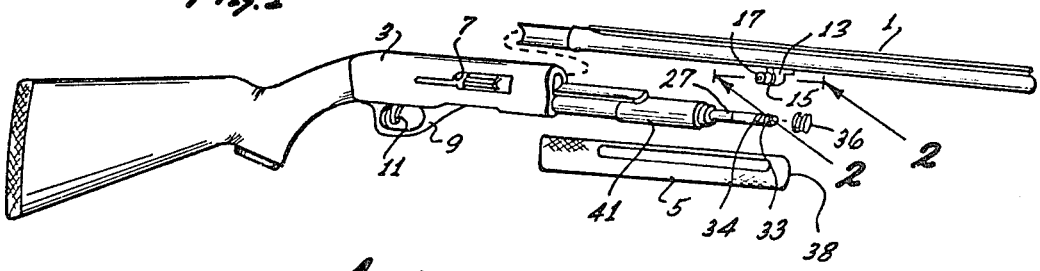
FIG. 1 is an isometric view of the firearm with the firearm barrel removed.

Referring to FIG. 1 in the drawings, a typical shotgun is shown with the barrel 1 removed from the receiver 3 and the slide grip cover 5. The typical receiver 3 has a side opening 7, which is a typical ejection port through which spent shells or cartridge cases are ejected, and a trigger guard 9 and trigger 11.

The construction of the receiver and barrel is typical of firearms of the type referred to with modifications as described herein added, to provide for regulation of the flow of gases from spent cartridges.

Figure 2:
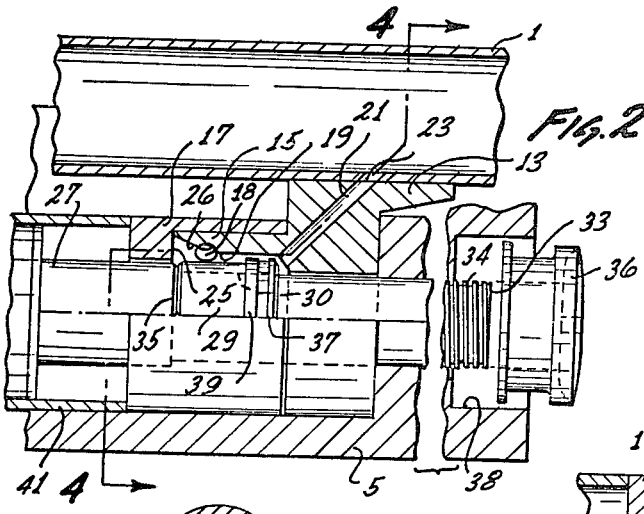
FIG. 2 is a sectional view taken along the line 2—2.

Referring to FIG. 2, which is a cross sectional view taken along the line 2—2 of FIG. 1, housing 13 is shown with a cylindrical protuberance 15 upon which piston 17 is slideably mounted. As can more readily be seen in FIG. 3, housing 13 contains an internal bore 19 which communicates with gas channel 21. The firearm barrel 1 contains an orifice 23 with which gas channel 21 is aligned. Referring to FIG. 4, it can be seen that housing 13 also houses gas channel 22 which aligns with orifice 24 of the firearm barrel. Protuberance 15 is sometimes referred to as a "receiver".

Cylindrical protuberance 15 has a tapered bore 26 which terminates into internal bore 19, thereby forming a chamber within housing 13 through which gases from firearm barrel 1 communicate through gas channels 21 and 22. Piston 17, which is slideably mounted around the periphery of cylindrical protuberance 15 is responsive to gas pressures within bore 19 and tapered bore 26. Gases acting upon internal face 25 of piston 17 cause said piston to move horizontally in relationship to fixed longitudinal member 27 and cylindrical protuberance 15. Protuberance 15 has holes 18 and 20 substantially at the juncture of bores 19 and 26, which may be spaced 90° apart to relieve the pressure acting on cylinder 17 when its end moves past these holes.

Referring to FIG. 2, end 33 of longitudinal member 27 contains threads 34 and inserts into slide grip cover 5 when the firearm is assembled. Locking nut 36 is internally threaded for engagement with threads 34 of said longitudinal member thereby permitting slide grip cover 5 upon the seating of locking nut 36 in countersunk bore 38 to firmly encase the assembled slide mechanism.

In the preferred embodiment of this invention, a gas metering plug 29, having an internal bore of diameter 30 for snug engagement with the surface of longitudinal member 27 slideably mounts upon said longitudinal member 27 over threaded end 33. The diameter of longitudinal member 27 contains a discontinuity or shoulder 35 which upon assembly of the firearm is in approximate alignment with the maximum diameter of tapered bore 26, at which discontinuity point 35 gas metering plug 29 is seated and thus restricted from further movement horizontally along longitudinal member 27. Discontinuity 35 also permits seating of gas metering plug 29 in the manner described when said plug is reversibly mounted on longitudinal member 27. Discontinuity 35 as shown in FIG. 3 may be an abrupt change in the diameter of longitudinal member 27 or in an alternative embodiment may consist of a snap ring and groove.

Figure 3:
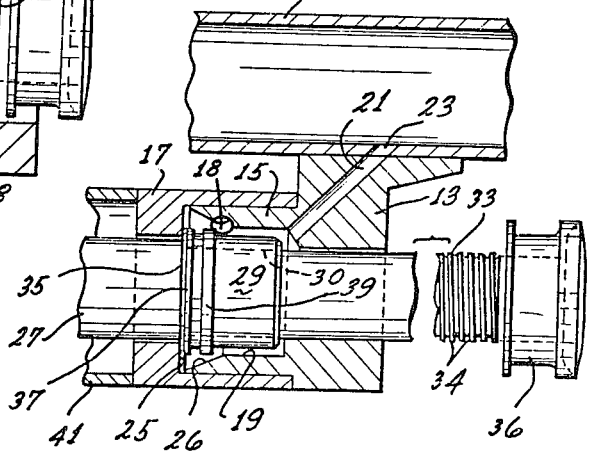
FIG. 3 is a sectional view taken along the line 2—2, depicting the metering plug reversed.
Figure 4:
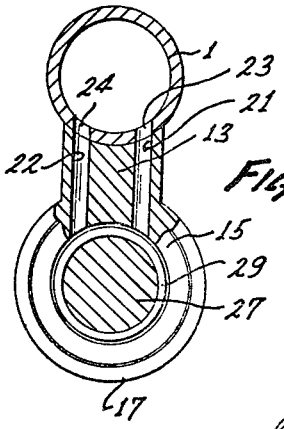
FIG. 4 is a sectional end view taken along the line 4—4.

Referring to FIGS. 2 and 3, it can be seen that gas metering plug 29 may be reciprocally mounted on longitudinal member 27 such that annular ribs 37 and 39 may be positioned either in the tapered bore 26 or internal bore 19 of housing 13. Thus the alternate positioning of gas metering plug 29 allows for a selectable clearance between said annular ribs and said tapered bore 26 or said internal bore 19. By selecting either of the aforesaid clearances, the flow of gases may be varied so as to control the pressure acting upon internal face 25 of piston 17.

Cylindrical sleeve 41 in the operation of a gas operated firearm articulates with a conventional means by which an automatic mechanism is actuated for extraction, ejection, feeding, and chambering of ammunition. Horizontal movement of piston 17 is transmitted to sleeve 41, which in turn actuates the automatic mechanism. Movement stops when the pressure is relieved through holes 23 and 27.

In operation where it is anticipated that high pressure loads will result from the use of magnum shot shell or the like barrel 1 is removed from the receiver 3 thereby exposing end 33 of longitudinal member 27. Gas metering plug 29 is then inserted over longitudinal member 27 at end 33. For high pressure loads, it is desirable that the flow of gases into or impinging upon piston 17 be reduced. This is accomplished by annular ribs 37 and 39 being positioned within internal bore 19 as shown on FIG. 2. Low pressure loads may be accommodated by reversing the position of gas metering plug 29 so that annular ribs 37 and 39 are positioned in tapered bore 26. After gas metering plug 29 is inserted onto longitudinal member 27 as previously described, said metering plug is seated at discontinuity 35. The firearm in final assembly has end 33 of longitudinal member 27 inserted into housing 13, as shown on FIGS. 2 and 3 depending upon the low or high pressure load anticipated.

Figure 5:
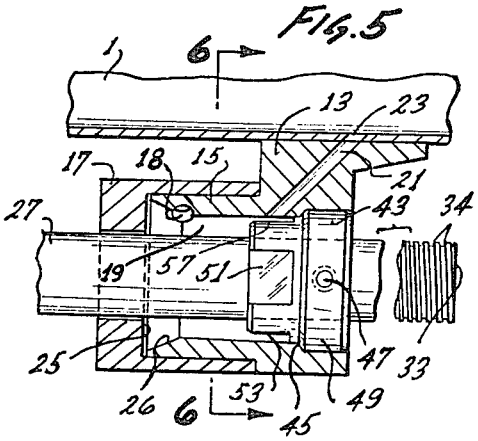
FIG. 5 is a sectional view taken along the line 2—2, depicting an alternate embodiment of the invention.
Figure 6:
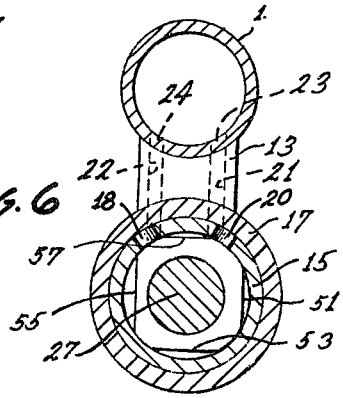
FIG. 6 is a sectional end view taken along the line 6—6.

An alternative embodiment of this invention is shown on FIGS. 5 and 6. Referring to FIG. 5, it can be seen that longitudinal member 27 is of uniform diameter without discontinuity. A rotatable gas metering plug 43 is rotatably mounted onto longitudinal member 27 and is seated in housing 13 by annular lip 45. A set screw 47 is utilized in annular section 49 of rotatable gas metering plug 43 such that tightening of set screw 47 will preclude rotation of said gas metering plug 43 relative to housing 13 or longitudinal member 27. As can be seen on FIG. 5, the portion of gas metering plug 43 which extends into internal bore 19 has flat surfaces 51, 53, 55, and 57, which are more clearly shown on FIG. 6. These surface faces are segments of circular arcs on the circumference of the extended portion of rotatable gas metering plug 43 which extends into internal bore 19. Clearance, therefore, between the wall of internal bore 19 and the flat surface of faces 51, 53, 55, and 57 may be changed by rotating metering plug 43 so as to place a selected one of said faces into communication with gas channels 21 and 22. The selection of a smaller clearance between the flat faces of gas metering plug 43 and the wall of internal bore 19 accommodates the use of high pressure shot shell loads and conversely the selection of a larger clearance between the flat face segments of metering plug 43 and internal bore 19 permits the use of low pressure shot shell loads without having to interchange firearm barrels.

The foregoing disclosure is representative of preferred forms of the invention and is to be interpreted in an illustrative rather than a limiting sense, the invention to be accorded the full scope of the claims appended hereto.

What is claimed is:

1. In a gas operated firearm having a gas operated piston for operating the action of the firearm, there being channel means for conveying gas from the barrel of the firearm to the piston means, the improvement comprising a metering device positioned for regulating a flow of gas through the channel means to the piston means, the metering device including cylinder means having an adjustable member positioned to restrict the flow of gasses between the metering device and the bore of the cylinder means, the adjustable member being a metering plug positioned in the bore of the cylinder means, the said metering plug having an annular rib, and said metering plug being reversible within the bore of the cylinder means.

* * * * *